United States Patent [19]

Stavric et al.

[11] Patent Number: 4,582,486

[45] Date of Patent: Apr. 15, 1986

[54] SUPPORT AND GUIDE MEANS FOR FIRING ELONGATED CERAMIC WARE

[75] Inventors: Zlatko Stavric, Bonn; Werner Pick, Swisttal-Olheim, both of Fed. Rep. of Germany

[73] Assignee: Norton Company, Worcester, Mass.

[21] Appl. No.: 706,982

[22] Filed: Feb. 28, 1985

[30] Foreign Application Priority Data

Jun. 8, 1984 [EP] European Pat. Off. ..... 84106564.2

[51] Int. Cl.[4] ..... F27D 5/00; C21B 3/00

[52] U.S. Cl. ..... 432/253; 266/274; 432/258

[58] Field of Search ..... 432/253, 258, 241; 266/274

[56] References Cited

U.S. PATENT DOCUMENTS 1,513,617 10/1924 Litt ..... 264/57
2,803,449 8/1957 Ludwig ..... 432/253
4,330,270 5/1982 Herrold ..... 432/259
4,354,830 10/1982 Gamble et al. ..... 432/258
4,462,798 7/1984 Foster ..... 432/241

FOREIGN PATENT DOCUMENTS 2464929 3/1981 France .

*Primary Examiner*—John J. Camby
*Attorney, Agent, or Firm*—Walter Fred

[57] ABSTRACT

A supporting and guiding means comprises a centrally disposed support column (6) at the upper end of which at least one slide tube (1) is secured paraxially. A holding and guiding device (2) is arranged on said slide tube and retaining plates (4) act at the ends of said device, the retaining plates (4) engaging in the upper open end of at least two insulators or similar elongated ceramic articles (7) arranged outside of the support column and, upon shrinking of the insulators (7), following the shrinking movement in axial direction while, at the same time, holding and guiding the insulators (7).

9 Claims, 2 Drawing Figures

SUPPORT AND GUIDE MEANS FOR FIRING ELONGATED CERAMIC WARE

BACKGROUND OF THE INVENTION

1. Field of the Invention

The invention relates to refractory kiln furniture and particularly a supporting and guiding means for use as a firing aid in the firing of hollow high tension electrical wire insulators and similar elongated ceramic or refractory ware having a length of about and more than 2 m (6.562 ft.), comprising a refractory support column or firing aid disposed on and supported by a movable carriage or kiln car and provided at its upper end with a movable guide member for holding and guiding the insulator during firing in a kiln.

2. Description of the Prior Art

With known supporting and guiding means of the kind recited above each individual electrical insulator is surrounded in part by a refractory support column composed of silicon carbide (SiC) rings and having at its upper end a movable guide member for supporting and guiding the insulator. As each insulator requires its own support column, the volumetric ratio between the firing aid or support column and material or insulator to be fired is approximately 4:1 which means that the firing procedure involves correspondingly high costs of firing. Moreover, the support column takes up relatively great space on the firing car so that the utilization of the space available is poor.

It is, therefore, the object of the invention to provide a supporting and guiding means having an improved volumetric ratio between the firing aid or support column and material or structure to be fired and permitting the firing or kiln car to be loaded at optimum utilization of the space available.

SUMMARY OF THE INVENTION

The object of the invention is met in that the refractory supporting and guiding means comprises a centrally arranged closed support column, at the upper end of which at least one slide means or tube is secured with the axes in parallel and guiding a holding and guiding device or means which is axially movable up and down and comprises at least two radially projecting arms, retaining plates acting at the ends of said arms and each engaging in the upper open end of at least two insulators arranged outside of the support column.

This supporting and guiding means thus permits it to hold several, but at least two, insulators on the carriage by using just one centrally disposed support column. The holding and guiding device which is movable up and down is adapted to follow the shrinking of the insulators or similar ceramic articles during firing because it comprises a cover plate which is guided so as to be movable up and down along the slide tube and to which at least one elongated retaining beam is secured for holding the two insulators or similar ceramic articles at its opposite ends.

In a preferred embodiment two elongated retaining beams are secured crosswise at the cover plate so as to hold four insulators. The free ends of the retaining beams project by the same lengths beyond the cover plate in order that the insulators may be positioned equidistantly on the movable car.

The insulators are held on the car by the holding and guiding device by virtue of the fact that the retaining beams comprise a circular plate each at their free ends for engagement in a guide ring which is inserted in the upper opening of the hollow insulator. In this manner an effective loose interconnection is obtained between the holding and guiding device and the insulators.

The cover plate preferably is formed with an arched or raised back and the upper retaining beam is placed in said arched portion, resting on a lower retaining beam.

In another preferred embodiment the holding and guiding device which is movable up and down is fastened by means of two slide tubes disposed paraxially and fixed to the upper end of the support column. In this manner any tilting of the guiding device is avoided.

The invention will be described in greater detail with reference to the accompanying drawing.

DESCRIPTION OF THE PREFERRED EMBODIMENTS(S)

Figure 2:
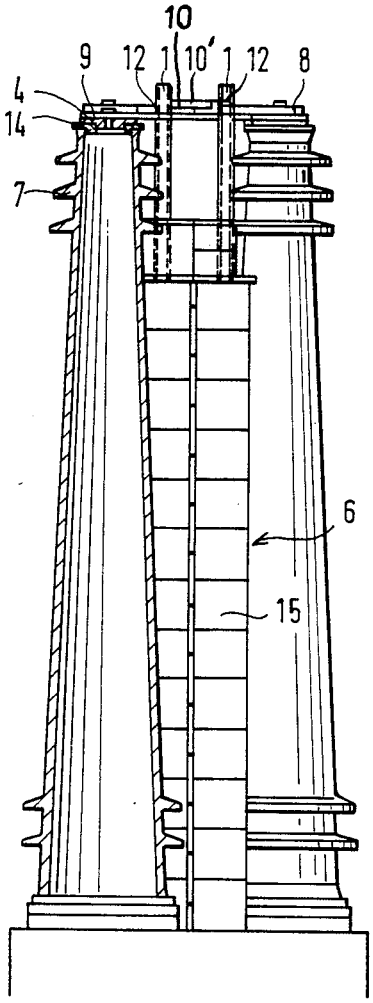
FIG. 2 is an elevational view, partly in section, of the supporting and guiding means shown in FIG. 1.
Figure 1:
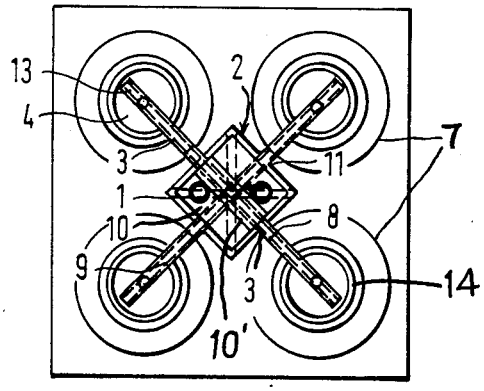
FIG. 1 is a top plan view of the supporting and guiding means, including four insulators arranged on a carriage.

In accordance with FIG. 1 the supporting and guiding means comprises a centrally and vertically arranged closed support column 6 at the upper end of which two slide tubes 1 are secured with their axes in parallel. They guide a holding and guiding device 2 which is movable up and down and comprises four radially projecting arms 3. As shown in FIG. 2, retaining plates 4 act at the ends of said arms and engage in the upper open ends 5 of four insulators 7 disposed outside of the support column 6. Two arms 3 are formed by each of a pair of crossing retaining beams 8 and 9 preferrably made of "Crystar" which is a registered trademark of Norton Company, Worcester, Mass. for its recrystallized silicon carbide refractories. Of the beams, the upper one 8 is fixedly placed in a channel provided in an arched back or raised upper portion 10' of a cover plate 10 of the holding and guiding device 2 and the lower one 9 is fastened to the bottom side of the cover plate 10 by pins 11, at right angles with respect to the superimposed retaining beam 8. Two apertures 12 are formed in the cover plate 10 of the holding and guiding means device 2 so that the holding and guiding device may be positioned on the slide tubes 1 and be movable up and down in an axial direction. The arms 3 of the retaining beams 8 and 9 crossing one another are made to the same lengths for optimum utilization of the space available on the carriage. In this manner the supporting and guiding means preferably can support and guide four enlongated insulators or similar ceramic or refractory ware in a square arrangement. At their free ends 13 the retaining beams 8 and 9 each comprise a plate 4 of circular configuration. Upon mounting of the insulators on the carriage these engage in a ring 14 provided in the upper open end 5 of each insulator 7, thus fastening the insulators on the car. During the firing and shrinking phase the holding and guiding device 2 which is freely movable up and down along each of the two slide tubes 1, with the axes parallel to the verticle central axes of the support column 6, slides down, while supportingly guiding the insulators 7. Thus, there is no risk that the insulators 7 might shift or tilt on the kiln car or support means. The central support column 6 (Guidar column) is built of interlocked SiC members, preferably of interlocked rings or sections 15 supported by and extending upwardly from the support means or kiln car on top of which the insulators are also placed and supported during firing in and movement into and out of the kiln.

From the above description it is obvious that the movable holding and guiding device 2 is first held in a raised position relative to the slide tubes or means. The insulators are then placed on the kiln car, arranged and spaced about the central support column 6 so that the upper open end 5 of each insulator and ring 14 placed therein is aligned with and engagable by the above retainer plate 4 attached to the end of an arm 3 of the holding and guiding means or device 2. The holding and guiding device 2 is then lowered so each retainer plate 4 loosely supportingly engages a refractory ring 14 also loosely fitted in the upper open end portion of each insulator supported by the holding and guiding device 2.

The kiln car including the holding and guiding device and insulators supported thereby are then transported into a kiln and fired at the required temperature and period of time. During firing the green insulators begin to shrink proportionally in all directions relative to its diameter, thickness, and length. Hence, the wall thickness and diameter of each green insulator will shrink much less in comparison to its much greater axial height or length. Therefore, the loosely fitted ring 14 is made sufficiently smaller in diameter so as to allow shrinkage of and not interfere with the upper open end of a completely fired insulator. Alternatively, the ring 14 may be a green unfired ring made of the same refractory material that shrinks at the same rate and simultaneously with the insulator, and into which a refractory retainer plate 4 of sufficiently smaller diameter is insertable to allow and compensate for shrinkage of and reduction in diameter of the ring 14 when fired. However, as the axial height or length of each insulator is gradually reduced during firing, the freely movable holding and guiding device 2 simultaneously and automatically slides downwardly on the tubes 1 and maintains supporting engagement with each insulator until completely fired, transported out of the kiln and removed from the device 2 and the kiln car.

Although the preferred embodiment of the invention is directed to firing high tension or voltage insulators it is obvious that the invention can also be utilized to fire similar relatively long elongated ceramic and refractory articles of various cross sectional shapes and lengths. It is also obvious that the supporting and guiding means of the invention can also be made of various refractory materials and mounted directly on the bottom or floor of a kiln or any type of base or support means other than the preferred kiln car disclosed above.

We claim:

1. A supporting and guiding means of refractory material for use in the firing of elongated ceramic articles in a kiln, comprising:

a central refractory support column disposed on and extending upwardly from a support means on which the elongated ceramic articles are arranged to extend upwardly about the support column, including at least one slide means secured to and extending upwardly from an upper end portion of the support column; and a holding and guiding means for the elongated ceramic articles mounted on and freely movable vertically relative to the slide means including at least two radially projecting arms, and retaining plates supported at the ends of the arms adapted for continuously supportingly engaging upper ends of at least two elongated ceramic articles arranged on the support means outside the support column during firing and shrinkage thereof in a kiln.

2. A supporting and guiding means acording to claim 1 wherein the holding and guiding means comprises:

a cover plate to which at least one elongated retaining beam is secured and provides the at least two radially projecting arms for holding two of the retaining plates and elongated ceramic articles.

3. A supporting and guiding means according to claim 1 wherein the holding and guiding means comprises:

a cover plate to which two elongated retaining beams are secured and provides four radially projecting arms for holding four of the retaining plates and elongated ceramic articles.

4. A supporting and guiding means according to claim 3 wherein the retaining beams are secured at right angles with respect to each other on the cover plate.

5. A supporting and guiding means according to claim 4 wherein the cover plate has a raised portion into which an upper one of the retaining beams is inserted and rests on a lower one of the retaining beams.

6. A supporting and guiding means according to claim 2 wherein the radially projecting arms of the retaining beams protrude substantially the same radial distance beyond the cover plate.

7. A supporting and guiding means according to claim 1 wherein the retaining plate at the end of each radially projecting arms is of circular configuration and engages in a ring inserted in an upper open end of the elongated ceramic article.

8. A supporting and guiding means according to claim 1 wherein the slide means comprises:

two slide tubes secured to the upper end of the support column with the axes extending in parallel.

9. A supporting and guiding means according to claim 1 wherein the elongated ceramic article is a hollow high tension electrical wire insulator.

* * * * *